US005707082A

United States Patent [19]

Murphy

[11] Patent Number: 5,707,082

[45] Date of Patent: Jan. 13, 1998

[54] THERMALLY IMAGED COLORED BAGGAGE TAGS

[76] Inventor: Sharon M. Murphy, c/o 2100 Sanders Rd., Suite 150, Northbrook, Ill. 60062-6132

[21] Appl. No.: 503,890

[22] Filed: Jul. 18, 1995

[51] Int. Cl.[6] ..... B41J 2/32

[52] U.S. Cl. ..... 283/67; 283/85; 283/114; 283/80

[58] Field of Search ..... 283/67, 80, 70, 283/85, 114, 117; 400/120.01, 120.02, 120.03

[56] References Cited

U.S. PATENT DOCUMENTS

| | | | |
|---|---|---|---|
| 3,752,312 | 8/1973 | Soltanoff . | |
| 3,808,718 | 5/1974 | Christiansen . | |
| 3,935,432 | 1/1976 | Maynard . | |
| 3,965,598 | 6/1976 | Avery . | |
| 3,994,085 | 11/1976 | Groselak et al. . | |
| 4,180,284 | 12/1979 | Ashley . | |
| 4,462,704 | 7/1984 | Kurata et al. | 400/120.02 |
| 4,544,287 | 10/1985 | Teraoka . | |
| 4,631,845 | 12/1986 | Samuel et al. . | |
| 4,697,938 | 10/1987 | Sakura et al. . | |
| 4,744,685 | 5/1988 | Mecke et al. . | |
| 4,817,310 | 4/1989 | Breen et al. . | |
| 4,820,551 | 4/1989 | Krauter et al. . | |
| 4,851,383 | 7/1989 | Fickenscher et al. . | |
| 4,870,427 | 9/1989 | Abstract . | |
| 4,882,861 | 11/1989 | Holmes et al. . | |
| 4,895,465 | 1/1990 | Mecke et al. . | |
| 4,916,841 | 4/1990 | Dawson . | |
| 4,938,617 | 7/1990 | Mecke et al. . | |
| 4,951,971 | 8/1990 | Whited . | |
| 4,983,445 | 1/1991 | Seiji . | |
| 5,058,959 | 10/1991 | Miles et al. . | |
| 5,089,350 | 2/1992 | Obringer et al. . | |
| 5,092,949 | 3/1992 | Goncalves . | |
| 5,132,139 | 7/1992 | Mecke et al. . | |

(List continued on next page.)

FOREIGN PATENT DOCUMENTS

| | | |
|---|---|---|
| 4117000 | 11/1992 | Germany . |
| 61-110580 | 5/1986 | Japan . |
| 61-273990 | 12/1986 | Japan . |
| 62-028267 | 2/1987 | Japan . |

(List continued on next page.)

OTHER PUBLICATIONS

"Imaging Processes and Material" Neblette's Eighth Edition, edited by Sturge et al; ©1989 by Van Nostrand Reinhold, pp. 274, 384–387.

*Primary Examiner*—Willmon Fridie, Jr.
*Attorney, Agent, or Firm*—Nixon & Vanderhye P.C.

[57] ABSTRACT

Colors (particularly colored stripes) and black and white indicia (such as bar coding and airport codes) are variably printed, preferably on direct thermal stock, using at least one direct thermal print head and a plurality of transfer thermal print heads, a plurality of differently colored wax ribbon strips (each strip preferably being a separate ribbon) associated with the transfer thermal print heads. A web or sheet of stock having a first, thermosensitive, surface is moved in the first direction, and while doing so variable black indicia is selectively applied to the first surface with the at least one direct thermal print head, while selectively moving one or more of the transfer thermal print heads into operative association with its associated colored wax ribbon so as to apply color from the ribbon onto the first surface of the web or sheet by thermal transfer. The stock is preferably label stock used for baggage tags, elongated in a first direction, and the color is applied in stripe form typically substantially in the first direction, and/or in a second direction substantially perpendicular to the first direction. The variable black indicia and the colored stripes may be applied substantially simultaneously, or sequentially. Baggage tags may either be linerless, or may have release sheets covering the adhesive. From two to seven differently colored wax stripes may be provided extending in the first direction.

21 Claims, 2 Drawing Sheets

U.S. PATENT DOCUMENTS

| | | | |
|---|---|---|---|
| 5,145,211 | 9/1992 | McKillip . | |
| 5,146,239 | 9/1992 | Ono . | |
| 5,167,456 | 12/1992 | Murakoshi et al. | 400/120.02 |
| 5,192,641 | 3/1993 | Seeley et al. . | |
| 5,226,994 | 7/1993 | Breen . | |
| 5,240,781 | 8/1993 | Yoshiyuki et al. . | |
| 5,357,702 | 10/1994 | Van Tuil et al. . | |
| 5,366,249 | 11/1994 | Diemert . | |
| 5,395,137 | 3/1995 | Kim . | |
| 5,395,667 | 3/1995 | Ohno et al. . | |
| 5,462,909 | 10/1995 | Lakes et al. . | |
| 5,466,075 | 11/1995 | Kouzai et al. | 400/120.02 |
| 5,486,057 | 1/1996 | Skinner et al. | 400/120.02 |
| 5,501,537 | 3/1996 | Kohno | 400/120.02 |

FOREIGN PATENT DOCUMENTS

| | | |
|---|---|---|
| 62-048590 | 3/1987 | Japan . |
| 63-059589 | 3/1988 | Japan . |
| 3266681 | 11/1991 | Japan . |
| 4033890 | 2/1992 | Japan . |
| 5139052 | 6/1993 | Japan . |

THERMALLY IMAGED COLORED BAGGAGE TAGS

BACKGROUND AND SUMMARY OF THE INVENTION

In the last two decades, the use of thermal systems to generate images on various types of paper stocks has significantly increased because they have several advantages for certain applications. There are two basic types of thermal systems, thermal transfer systems in which a material is transferred from one stratum to a stock sheet, and direct thermal transfer in which a thermosensitive coating is provided on the stock and indicia formed by chemical or physical processes in the coating as a result of bringing particularly shaped thermal elements into contact with the stock. Both systems use is thermal print heads consisting of miniature resisters that are either in a straight line or a matrix, and become heated in response to current pulses.

One particular area where thermal printing has been used advantageously is in the printing of baggage tags, such as for airlines or trains. Tags made of direct thermal stock (such as shown in U.S. Pat. No. 5,146,239) are strong and tough, and may be simply produced on site to include a wide variety of variable images, including bar coding. However in the past the ability to apply color coding to the baggage tag in a variable manner has been much less effective than desired. While color coding offers a wide variety of advantages for baggage tags, allowing luggage to be clearly and simply distinguished by destination, priority handling, or the like, it has not been widely used in practice. As recognized in said U.S. Pat. No. 5,146,239, while special heat-sensitive coloring paper is available, it is not easy to handle, and it is difficult to obtain desired colors therefrom. The solution provided in said U.S. Pat. No. 5,146,239, however, is also very restricted in application, comprising pre-applying colored strips to the stock and then using perforated viewing mechanisms on other portions of the stock to read the colors. It is difficult to see the colors under such circumstances because the colored area is so small, and there is little versatility associated therewith.

According to the present invention it is possible to overcome the problems in the prior art and to easily apply readily discernible variable colored configurations, such as stripes, to direct thermal stock. Special direct thermal stock is not necessary, and the colors to be applied are almost unlimited in configuration and extent. [In the specification and claims the term "color" refers to other colors besides black, white, and gray.]

According to one aspect of the present invention a method of variably printing colors and indicia on direct thermal stock, using at least one direct thermal print head, a plurality of transfer thermal print heads, and a plurality of differently colored wax ribbon strips associated with the transfer thermal print heads, is provided. The method comprises the following steps: (a) Moving a web or sheet of direct thermal stock having a first, thermosensitive, surface in a first direction; and substantially while practicing step (a): (b) Selectively applying variable black indicia to the web or sheet first surface with at least one direct thermal print head; and, (c) selectively moving one or more of the transfer thermal print heads into operative association with its associated color wax ribbon strip so as to apply color from the strip onto the first surface of the web or sheet by thermal transfer.

Preferably the differently colored strips are on different ribbons, step (c) being practiced by selectively moving only that ribbon or those ribbons whose color is to be printed on the web or sheet first surface. When the direct thermal stock is in web form, there typically is the further step—after steps (b) and (c)—of severing an individual sheet having indicia from step (b) and color from step (c) applied thereto from the rest of the web. Steps (b) and (c) may be practiced substantially simultaneously, or sequentially (with either step (b) being first or step (c) being first).

Step (c) is typically practiced to apply at least one stripe (either continuous or discontinuous) of color to the stock substantially in the first direction. However alternatively, or additionally, step (c) may be practiced to apply at least one stripe of color to the stock in a second direction, substantially transverse to the first direction.

As indicated above, the particularly desirable use for the method of present invention is in the preparation of baggage tags, baggage tags going to different destinations and for different priorities of luggage being able to be simply variably printed directly at the baggage handling site. Under these circumstances the stock may be a linerless label stock having a first surface thereof with a release material coating and a second surface with an adhesive coating, in which case steps (b) and (c) are in part practiced by passing the second surface over an anvil having a non-stick surface and wherein step (b) is practiced to at least in part print baggage tag bar code indicia, and/or corresponding or additional human readable indicia (such as airport codes), thereon. Alternatively the stock may be lined label stock with an adhesive surface opposite the first surface.

According to another aspect of the present invention a baggage tag is provided comprising the following components: A sheet of material having a first, thermosensitive, surface, and a second surface with adhesive. Variable baggage tag indicia, including black bar coding, direct thermal printed on the first surface. And, variable colored wax of at least one color laid down by thermal transfer on the first surface in a predetermined configuration.

The colored wax may be laid down in a number of different configurations, typically in at least one stripe configuration. Where the sheet is elongated in a first direction the at least one stripe configuration may be either substantially in the first direction or substantially transverse thereto. The second surface of the sheet of material may have a release sheet backing, or it may be devoid of a release sheet backing (i.e. comprising linerless label stock). The sheet may be part of a web, separated from other sheets in the web by lines of weakness, which are manually detached when the baggage tag is being applied to luggage. The at least one color of wax configuration preferably comprises between 2–7 differently colored wax configurations on the first surface.

While the invention is most ideally practiced utilizing direct thermal stock, under some circumstances other stock may be utilized, and the black variable indicia (such as bar coding, airport destination codes, and the like) may be applied utilizing other transfer thermal print heads.

It is the primary object of the present invention to provide for the production of baggage tags or the like which effectively use variable color coding which may be applied directly at the baggage handling site. This and other objects of the invention will become clear from an inspection of the detailed description of the invention, and from the appended claims.

DETAILED DESCRIPTION OF THE DRAWINGS

Figure 1:
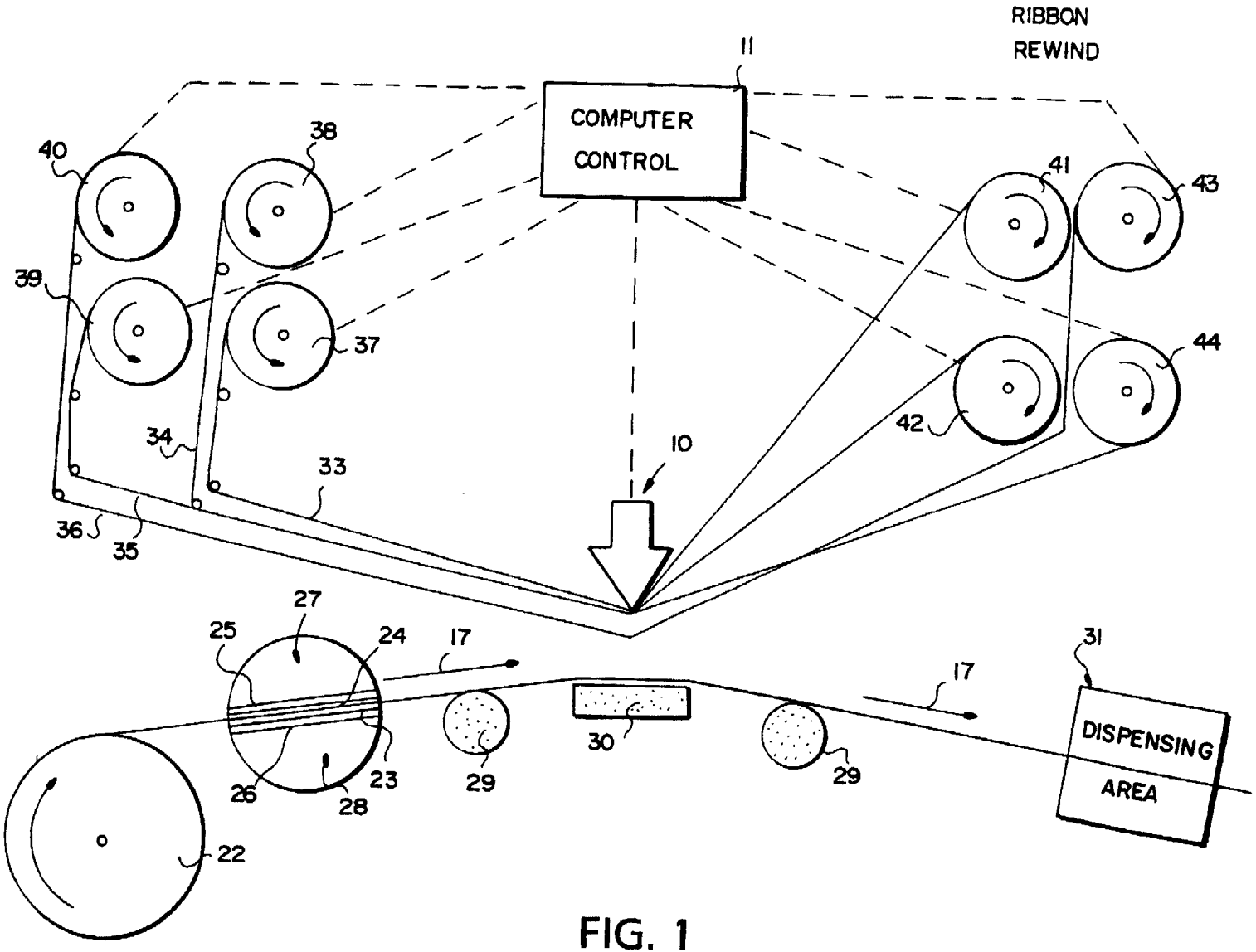
FIG. 1 is a side schematic view showing exemplary apparatus for practice of an exemplary method according to the invention to produce exemplary baggage tags according to the present invention.
Figure 2:
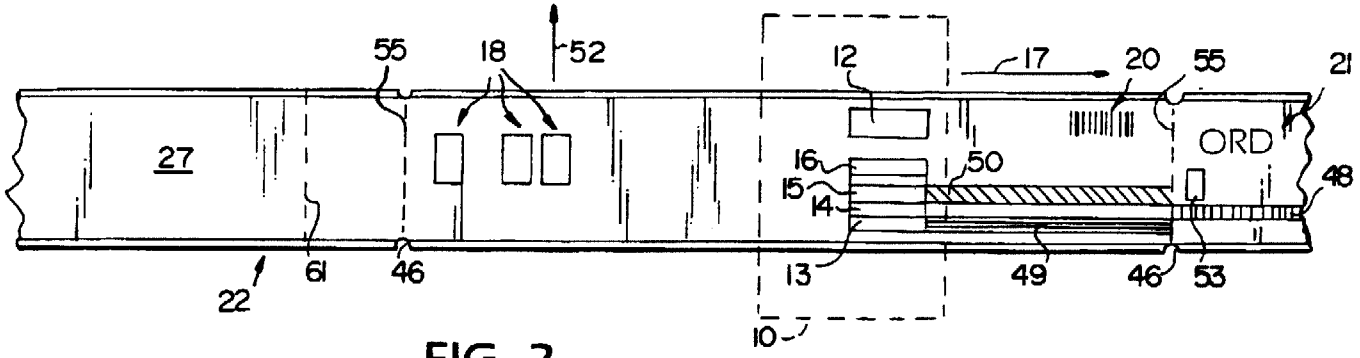
FIG. 2 is a top plan view of inter-connected individual baggage tags that may be produced utilizing the apparatus of FIG. 1, schematically showing thermal print heads (but not colored ribbons) overlying the baggage tag.

FIG. 1 schematically illustrates exemplary apparatus that may be utilized for the practice of the method of the present invention to produce baggage tags, or like paper products, according to the invention. The apparatus of FIG. 1 includes a thermal printer shown schematically by reference numeral 10. The thermal printer will include a plurality of thermal print heads comprising miniature resistors that are either in straight line or matrix configurations and become heated in response to current pulses, which may be controlled by a control mechanism such as the computer control illustrated schematically at 11 in FIG. 1. While the thermal printer 10 is basically a conventional printer, such as available from DataMax Bar Code Corporation of Flying Cloud, Minnesota, in the preferred embodiment according to the present invention the printer 10 will have two different types of print heads. It will have at least one direct thermal print head—such as illustrated schematically at 12 in FIG. 2—and a plurality of transfer thermal print heads—shown schematically at 13 through 16 in FIG. 2 [typically 2–7 transfer thermal print heads being provided]. Note that the print heads 13 through 16 schematically illustrated in FIG. 2 are all aligned in a first direction 17. If desired a plurality of other thermal transfer print heads—shown schematically collectively at 18 in FIG. 2—may also be provided, the heads 18 substantially transverse to heads 13–16.

The direct thermal print head 12 is a conventional type for printing black indicia, such as bar coding 20 (see FIG. 2) and/or human readable indicia (such as the airport code 21), while the transfer print heads 13 through 16 cooperate with colored ribbons or colored ribbon portions, as will be hereinafter described.

The method of the present invention is practiced—in the FIGS. 1 and 2 embodiment—on linerless label stock, e.g. from a roll 22. The circled area in FIG. 1 illustrates typical component parts of the linerless stock 22, comprising a paper web 23 having thermosensitive material 24 in a coating thereon, with a release coat (which releases from adhesive) 25 over all or part of the coat 24 depending upon how the pressure sensitive adhesive 26 coats the bottom (as viewed in FIG. 1) of the paper web 23. Thus the stock 22 includes a first surface 27 to which the indicia which will be applied by the print heads 12 through 16 is applied, and a second surface 28 containing the adhesive 26 (e.g. permanent pressure sensitive adhesive). For example a typical thermal stock 22 is as shown in U.S. Pat. No. 5,292,713.

Since linerless label stock 22 is being handled in the FIG. 2 embodiment, the rollers 29 which engage the second surface 28 will be of non-stick material (e.g. plasma coated), as will be the top surface of an anvil 30 which cooperates with the print heads 12 through 16 of the printer 10. At the area of the anvil 30 imaging of the top surface 27 of the stock 22 takes place, and downstream of the anvil 30 dispensing occurs in any conventional or desired manner, illustrated only schematically by the dispensing area/mechanism 31 in FIG. 1.

In order to apply color utilizing the transfer thermal print heads 13 through 16, a plurality of differently colored wax ribbon strips are provided associated with the print heads 13 through 16. In the preferred embodiment the wax ribbon strips are provided on different ribbons—such as the ribbons 33 through 36 illustrated in FIG. 1—however, if desired the differently colored strips may be different portions (side-by-side) of the same ribbon. In the FIG. 1 embodiment where different ribbons 33 through 36 are utilized they are each unwound from their own unwind mechanism 37–40, respectively, and taken up (rewound) on another mechanism downstream of the printer 10, as illustrated schematically by the mechanisms 41–44, respectively. The common control 11 may control all of the unwind and rewind mechanisms 37–44.

The colored wax ribbons may be of any conventional or known construction, such as shown in U.S. Pat. Nos. 5,089,350, 5,240,781, 4,983,445, or 4,820,551, or Japanese published applications 4033890 or 5139052, or other, commercially available, constructions.

FIG. 2 schematically illustrates the use of the printer 10 to apply different indicia on the label stock 22 first surface 27. As the stock 22 moves in the first direction 17, it passes the print heads 12 through 16. Depending upon what the destination of the baggage associated with the baggage tag 46 being printed is, and what the priority of handling of the luggage is, the direct thermal print head 12 is controlled to print an appropriate black bar code 20 and/or other baggage indicia, such as a human readable number and/or airport code indicia (21 in FIG. 2). Again, depending upon destination, priority, or the like, one or more of the print heads 13–16 is activated to come into contact with its associated colored wax ribbon 33–36 to apply color from the ribbon 33–36 by thermal transfer to the surface 27. For example in the FIG. 2 embodiment, for the tag just preceding the tag 46, the print head 14 was activated which applied the red stripe 48 (which is shown as continuous but could also be discontinuous, e.g. made up of dots, squares, rectangles, or other shapes of aligned or staggered elements), while for the baggage tag 46 the print heads 13, 15 are shown being activated to print the blue stripe 49 and the green stripe 50. For example the red stripe 48 might indicate transfer of luggage at Atlanta's airport, while the combination of the blue and green stripes 49, 50 might indicate a direct flight to New York LaGuardia Airport. The print heads 13–16 may be activated for any length of time to form stripes or other configurations of any desired length, but in order to provide the clearest visibility are typically activated almost the entire length of the baggage tag 46 in the direction 17.

If cross-colored stripes or other configurations are desired for other purposes (such as to further indicate priority handling or the like), then wax ribbons may also be associated with the print heads 18 and move in a direction 52 (see FIG. 2) which is substantially perpendicular to the direction 17. In this way cross-stripes may be applied, such as the orange cross-stripe 53 applied by one of the print heads 18 under the control of the computer 11 on the tag preceding so the tag 46 in FIG. 2.

FIG. 2 also shows that the web of label stock 22 may be pre-separated into individual tags, such as by lines of weakness (e.g. perforations, cut outs, and/or slits or score lines) 55, i.e. defining the front and trailing edges of the baggage tag 46. At the dispensing area or mechanism 31 each individual tag 46 is separated from at least the trailing tag by detachment along perforation line 55. Alternatively, the dispensing area or mechanism 31 may comprise cutting mechanisms to cut the stock 22 into individual tags 46 in which case the lines of weakness 55 are less important or unnecessary.

Figure 3:
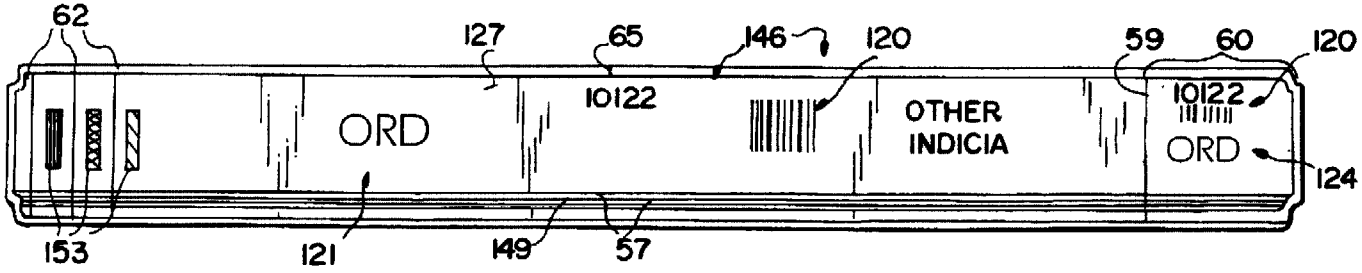
FIG. 3 is a top plan view of a lined label configuration of baggage tag produced according to the present invention.
Figure 4:
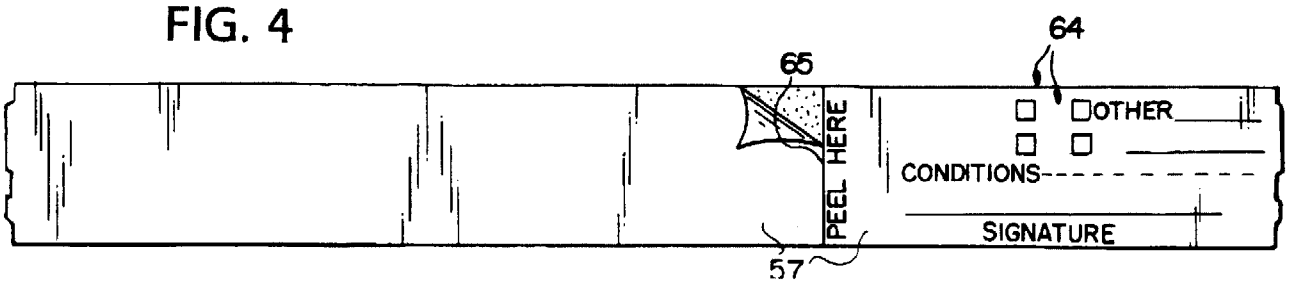
FIG. 4 is a bottom view of the baggage tag of FIG. 3.

FIGS. 3 and 4 show an exemplary baggage tag in final form as it is produced according to the present invention. In FIGS. 3 and 4 the baggage tag is of lined label stock rather than linerless stock 22 as seen in FIGS. 1 and 2. The only difference is the lack of any need for a release coat on the first surface of the stock, and the existence of a release liner 57. In FIGS. 3 and 4 components that are the same as or comparable to those in FIGS. 1 and 2 embodiment are shown by the same reference numeral only preceded by a "1".

Note in the FIGS. 3 and 4 embodiment, that different additional provisions may be provided in the tag 146, for example a slit 59 in the label stock separating the tag 146 into two distinct portions including the "check" portion 60 (which may be also provided in the FIG. 2 embodiment by other lines of weakness such as the line of weakness 61 illustrated in FIG. 2), as well as further slits 62 on the left portion of the tag 146 that may be used for a wide variety of purposes, and which may have differently colored cross-stripes 153 printed thereon. As seen in FIG. 4, additional indicia—such as waiver indicia, boxes to be filled in indicating the type or condition of the luggage, etc.—may be printed—as illustrated schematically at 64 in FIG. 4—on the back of the release sheet 57, and when the release sheet 57 is removed—typically by peeling back at the slit 65—the portion with the indicia 64 retained by the ticket agent.

While the invention has been herein shown and described that the preferred embodiment in which the indicia 20, 21, 120, 121, etc., are applied by a direct thermal print head 12 (or more than one such head) on thermal stock 22, the black bar code and numerical indicia 20, 21, and the like may also be applied by thermal transfer, although then there will be the additional complication of the transfer ribbon or ribbons being associated with the head or heads 12. Also virtually any indicia may be provided on the baggage tags 46, 146, and the method according to the present invention may be used to produce other products which desirably have the colored configurations (such as stripes) associated therewith aside from baggage tags (including labels produced by scales for food or bulk items purchased by weight, etc.), or where the colored configurations (such as the stripes 49, 149) are sensed by equipment acting on the stock to divert it, fold it, cut it, or otherwise act upon it.

While the invention has been herein shown and described in what is presently conceived to be the most practical and preferred embodiment thereof it will be apparent to those of ordinary skill in the art that many modifications may be made thereof within the scope of the invention, which scope is to be accorded the broadest interpretation of the appended claims so as to encompass all equivalent products and methods.

What is claimed is:

1. A method of variably printing colors and indicia on direct thermal stock, using at least one direct thermal print head, a plurality of transfer thermal print heads, and a plurality of differently colored wax ribbon strips associated with the transfer thermal print heads, said method comprising the steps of:

(a) moving a web or sheet of direct thermal stock having a first, thermosensitive, surface in a first direction; and substantially while practicing step (a):

(b) selectively applying variable black indicia to the web or sheet first surface with at least one direct thermal print head; and (c) selectively moving one or more of the transfer thermal print heads into operative association with its associated color wax ribbon strip so as to apply color from the strip onto the first surface of the web or sheet by thermal transfer.

2. A method as recited in claim 1 wherein the differently colored strips are on different ribbons, and wherein step (c) is practiced by selectively moving only that ribbon or those ribbons whose color is to be printed on the web or sheet first surface.

3. A method as recited in claim 1 wherein the direct thermal stock is in web form, and comprising the further step, after steps (b) and (c), of severing an individual sheet having indicia from step (b) and color from step (c) applied thereto from the rest of the web.

4. A method as recited in claim 1 wherein the at least one direct thermal print head and the plurality of transfer thermal print heads are substantially side-by-side with each other; and wherein steps (b) and (c) are practiced substantially simultaneously using the substantially side-by-side print heads.

5. A method as recited in claim 1 wherein steps (b) and (c) are practiced sequentially.

6. A method as recited in claim 1 wherein step (c) is practiced to apply at least one stripe of color to the stock substantially in the first direction.

7. A method as recited in claim 1 wherein step (c) is practiced to apply at least one stripe of color to the stock in a second direction, substantially transverse to the first direction.

8. A method as recited in claim 1 wherein the stock is a linerless label stock, the first surface thereof having a release material coating, and having a second surface with an adhesive coating, and wherein steps (b) and (c) are in part practiced by passing the second surface over an anvil having a non-stick surface.

9. A method as recited in claim 8 wherein the stock after printing has baggage tag indicia thereon, and wherein step (b) is practiced at least in part to print baggage tag bar code indicia thereon.

10. A method as recited in claim 1 wherein the stock is lined label stock, including an adhesive surface opposite the first surface; and wherein step (b) is practiced at least in part to print variable bag tag indicia on the first surface.

11. A method of variably printing colors and indicia on thermal transfer stock, utilizing at least one first thermal transfer print head, and a plurality of second transfer thermal print heads, substantially side-by-side with each other and with the at least one thermal transfer print head; and a plurality of differently colored wax ribbon strips associated with the second transfer thermal print heads, said method comprising the steps of:

(a) moving a web or sheet of thermal transfer stock having a first surface in a first direction, and while practicing this step:

(b) selectively applying variable black indicia to the web or sheet first face using the at least one first thermal transfer print head; and (c) substantially simultaneously with step (b) selectively moving one or more of the substantially side-by-side second transfer thermal print heads into operative association with its associated colored wax ribbon strip so as to apply color onto the first surface of the web or sheet by thermal transfer.

12. A method as recited in claim 11 wherein the differently colored strips are on different ribbons, and wherein step (c) is practiced by selectively moving only that ribbon or those ribbons whose color is to be printed on the web or sheet first surface.

13. A method as recited in claim 11 wherein step (c) is practiced to apply at least one stripe of color to the stock substantially in the first direction.

14. A method as recited in claim 11 wherein step (c) is practiced to apply at least one stripe of color to the stock in a second direction, substantially transverse to the first direction.

15. A method as recited in claim 11 wherein the stock is lined label stock, including an adhesive surface opposite the first surface; and wherein step (b) is practiced at least in part to print variable bag tag indicia on the first surface.

16. A method as recited in claim 2 wherein the stock is a linerless label stock, the first surface thereof having a release material coating, and having a second surface with an adhesive coating, and wherein steps (b) and (c) are in part practiced by passing the second surface over an anvil having a non-stick surface.

17. A method as recited in claim 16 wherein the stock after printing has baggage tag indicia thereon, and wherein step (b) is practiced at least in part to print baggage tag bar code indicia thereon.

18. A method as recited in claim 3 wherein the stock is a linerless label stock, the first surface thereof having a release material coating, and having a second surface with an adhesive coating, and wherein steps (b) and (c) are in part practiced by passing the second surface over an anvil having a non-stick surface.

19. A method of variably printing colors and indicia on a web of thermal transfer stock, utilizing at least one first thermal transfer print head, and a plurality of second transfer thermal print heads, and a plurality of differently colored wax ribbon strips associated with the second transfer thermal print heads, the stock web comprising label stock having a first surface and an adhesive surface opposite the first surface; said method comprising the steps of:

(a) moving the web of thermal transfer stock in a first direction, and while practicing this step:

(b) selectively applying variable black indicia to the web first face, remote from the adhesive surface, using the at least one first thermal transfer print head; and (c) selectively moving one or more of the second transfer thermal print heads into operative association with its associated colored wax ribbon strip so as to apply color onto the first surface of the web by thermal transfer.

20. A method as recited in claim 19 wherein the stock is lined label stock; and wherein step (b) is practiced at least in part to print variable bag tag indicia on the first surface.

21. A method as recited in claim 19 wherein the stock is a linerless label stock, the first surface thereof having a release material coating, and having a second surface with the adhesive coating, and wherein steps (b) and (c) are in part practiced by passing the second surface over an anvil having a non-stick surface.

* * * * *

UNITED STATES PATENT AND TRADEMARK OFFICE

CERTIFICATE OF CORRECTION

PATENT NO. : 5,707,082

DATED : January 13, 1998

INVENTOR(S) : Sharon M. Murphy

It is certified that error appears in the above-identified patent and that said Letters Patent is hereby corrected as shown below:

On the title page, the following should be inserted:

--[73] Assignee: Moore Business Forms, Inc., Grand Island, N.Y. --

Signed and Sealed this

Seventeenth Day of November, 1998

*Attest:*

Bruce Lehman

BRUCE LEHMAN

*Attesting Officer*

*Commissioner of Patents and Trademarks*